United States Patent [19]

Wilber

[11] 4,394,962

[45] Jul. 26, 1983

[54] SOLENOID OPERATED FUEL INJECTOR AND CONTROL VALVE

[75] Inventor: Dennis A. Wilber, Elizabethtown, Ind.

[73] Assignee: Cummins Engine Company, Inc., Columbus, Ind.

[21] Appl. No.: 237,257

[22] Filed: Feb. 23, 1981

[51] Int. Cl.[3] ..... F02M 47/02

[52] U.S. Cl. ..... 239/88; 239/585

[58] Field of Search ..... 239/88, 90, 93, 96, 239/533.5, 585; 251/129

[56] References Cited

U.S. PATENT DOCUMENTS

| | | | |
|---|---|---|---|
| 2,229,499 | 1/1941 | Fisette | 188/112 |
| 2,792,195 | 5/1957 | Mosbacher | 251/77 |
| 3,368,791 | 2/1968 | Wells | 251/129 |
| 3,464,668 | 9/1969 | Jacob | 251/129 |
| 4,018,419 | 4/1977 | Monpetit | 251/129 X |
| 4,129,253 | 12/1978 | Bader et al. | 239/88 |
| 4,129,254 | 12/1978 | Bader, Jr. et al. | 239/88 |
| 4,235,374 | 11/1980 | Walter et al. | 239/90 |

FOREIGN PATENT DOCUMENTS

| | | | |
|---|---|---|---|
| 2814368 | 11/1978 | Fed. Rep. of Germany | 251/129 |

*Primary Examiner*—John J. Love

*Assistant Examiner*—Gene A. Church

*Attorney, Agent, or Firm*—Sixbey, Friedman & Leedom

[57] ABSTRACT

A fuel injector and valve assembly (2) including a unit injector (4) having a main pumping plunger (10) and a shuttle piston (14) selectively connected to the pumping plunger by means of a hydraulic link controlled by a ball-type solenoid operated valve (28). The valve includes a housing (58) containing a valve cavity (76) in which a ball (78) is positioned for movement between a closed position and open position in less than one millisecond to control the timing and metering function of the fuel injector (4). The ball (78) is biased to the closed position by a spring (88) and is moved to an open position by an operator stem (98) biased by a stronger opposing spring (116) surrounding the operator stem (98). The operator stem (98) is withdrawn by energization of solenoid (118) to allow the ball (78) to be moved to the closed position by the ball spring (88). An extremely simple structural configuration is employed including inner and outer valve housing members (62,72) arranged to form valve cavity (76) when assembled and including an operator housing (90) connected in a manner to allow the retracted position of the operator stem (98) to be adjusted by simple relative rotational movement of the operator and valve housings (58,90).

16 Claims, 4 Drawing Figures

LOW PRESSURE FUEL SUPPLY

SOLENOID OPERATED FUEL INJECTOR AND CONTROL VALVE

TECHNICAL FIELD

This invention relates to a low cost, fast acting solenoid valve for sealing very high pressure when closed and for accommodating relatively high volume bidirectional flow when opened such as required in electronically controlled fuel injectors for internal combustion engines.

BACKGROUND ART

Electronically controlled fuel injectors for internal combustion engines, such as disclosed in U.S. Pat. No. 4,129,254 to Bader, Jr. et al, have enjoyed only limited acceptance despite their promise of significantly improved fuel efficiency and pollution abutment. A major factor tending to impede wider use has been the complexity and high cost of commercially available units. Only when major compromises in performance are tolerable have simplication and cost reduction been possible.

Recently, a simplified design for an electronically controlled fuel injector has been disclosed in U.S. Pat. No. 4,235,374 to Walter et al by which fuel injection may be both timed and metered electronically on a cycle-by-cycle basis using only a single electrically controlled valve. The '374 injector is characterized by a very simple mechanical structure including a cam operated primary pumping plunger and a secondary plunger hydraulically linked to the primary pumping plunger at selected times during the reciprocating motion of the primary pumping plunger. A single electronically controlled valve operates, upon closing, to form the hydraulic link and, upon opening, to break the hydraulic link by allowing liquid to flow freely into and out of the hydraulic link forming chamber. While quite simple in concept, extremely severe operating requirements are imposed on the electrically controlled valve since it must be capable of sealing back pressures in excess of 15,000 psi during injection periods and must be capable of accommodating sufficient flow volumes to allow the hydraulic link to be adjusted selectively on a cycle-by-cycle basis to produce the desired metering and timing functions. Moreover, a satisfactory valve must also be capable of moving between a fully closed position and a fully open position in less than 1 millisecond and must be relatively inexpensive to manufacture and failsafe in operation.

No previously known valve design is capable of meeting all of the above desired characteristics. For example, magnetically operated valves such as illustrated in U.S. Pat. No. 3,368,791 include a spool type valve plunger requiring expensive, high-tolerance machining operations and a relatively high inertia plunger and operator which would make the necessary speed of operation and flow handling capability difficult if not impossible to achieve. Lower cost ball-type valves (such as illustrated in U.S. Pat. Nos. 2,229,499; 2,792,195 and 3,464,668) are known but such valves also fail to provide high speed operation and satisfactory flow capacity while at the same time providing the necessary back flow sealing ability. For example, U.S. Pat. No. 2,792,195 to Mosbacher discloses a solenoid operated valve including a ball type valve element spring biased toward a closed position and moved to an open position by a spring biased valve operator which can only be rendered inoperative, thereby allowing the valve to close, when the operator is retracted against spring pressure by an electronically energized coil. While useful for the purposes intended, a Mosbacher type valve could not satisfy the operating criteria listed above because the valve operator relies on momentum build up rather than primarily spring force to move the ball element to its open position. Further increase in the size of the valve operator to permit a larger size spring would merely increase the inertia of the operator and work against achievement of the desired high speed operation. Reliance on the momentum imparted to the operator to open the ball valve also requires a significant gap between the valve operator and the valve to allow momentum build up upon de-energization of the coil. Such a large gap also works against high speed operation. Attempts to reduce this gap by increased spring force not only presents the inertia problem discussed above, but also introduces manufacturing tolerance which presents the possibility of improper valve closure. Still another problem is that a Mosbacher-type valve could probably not resist back pressures in excess of 1,500 psi and certainly could not resist back pressures in excess of 15,000 psi because of the use of O rings to seal the valve seat element.

In short, no valve design is known which would satisfy the operating characteristics imposed by a unit injector as discussed above while also meeting the requirement of low cost manufacture and reliability.

DISCLOSURE OF THE INVENTION

The primary object of the subject invention is to provide a fast acting, low cost solenoid operated valve which is capable of resisting significant back pressure when closed and of accommodating substantial flow rates in either direction when opened.

A more particular object of this invention is to provide a practical solenoid operated valve for controlling the metering and timing function of an intermittent fuel injector.

A still more specific object of the subject invention is to provide a low cost, ball-type valve capable of resisting back pressures in excess of 15,000 psi and of moving from a fully closed to a fully open position in no more than one millisecond.

Another object of this invention is to provide a solenoid operated ball-type valve for use with a fuel injector employing a cam actuated main pumping plunger and an auxiliary shuttle piston wherein the solenoid operated valve is responsive to an electrical signal to make and break a hydraulic link between the plunger and piston to regulate both timing and metering on a cycle-to-cycle basis.

Yet another object of the subject invention is to provide a solenoid operated ball-type valve which is highly reliable in operation, capable of sealing very high back pressures, extremely fast acting, and yet is also inexpensive to manufacture because variations resulting from manufacturing tolerances can be compensated for by an easily adjustable connection between the valve housing and the valve operator.

The above and additional objects of the subject invention are achieved by an injector assembly including a valve housing containing a valve cavity in which a ball is positioned for movement between a closed position and an open position in less than one millisecond to control the timing and metering function of a fuel injector. The ball is biased toward the closed position by a spring sufficiently strong to maintain the ball in its closed position against the fluid supply pressure and is moved to its open position by a valve operator. The operator which has a stem for contacting the ball is biased in the direction of the ball by an operator spring surrounding the stem. The operator spring may be rendered ineffective by a solenoid which compresses the operator spring upon energization to allow the ball to be moved to the closed position by the ball spring. When the solenoid is de-energized, the operator spring is released and is sufficiently strong to dislodge the ball and move it to its fully open position. An extremely simple structural configuration is employed including inner and outer valve housing members arranged to form the valve cavity when assembled and including an operator housing threadedly connected in a manner to allow the operator stem to be axially positioned relative to the ball valve element by simple relative rotational movement of the operator and valve housings. Other more specific functional and structural advantages of the subject invention may be appreciated by a consideration of the following Brief Description of the Drawings and the Best Mode for Carrying Out the Invention.

BEST MODE OF CARRYING OUT THE INVENTION

Figure 1:
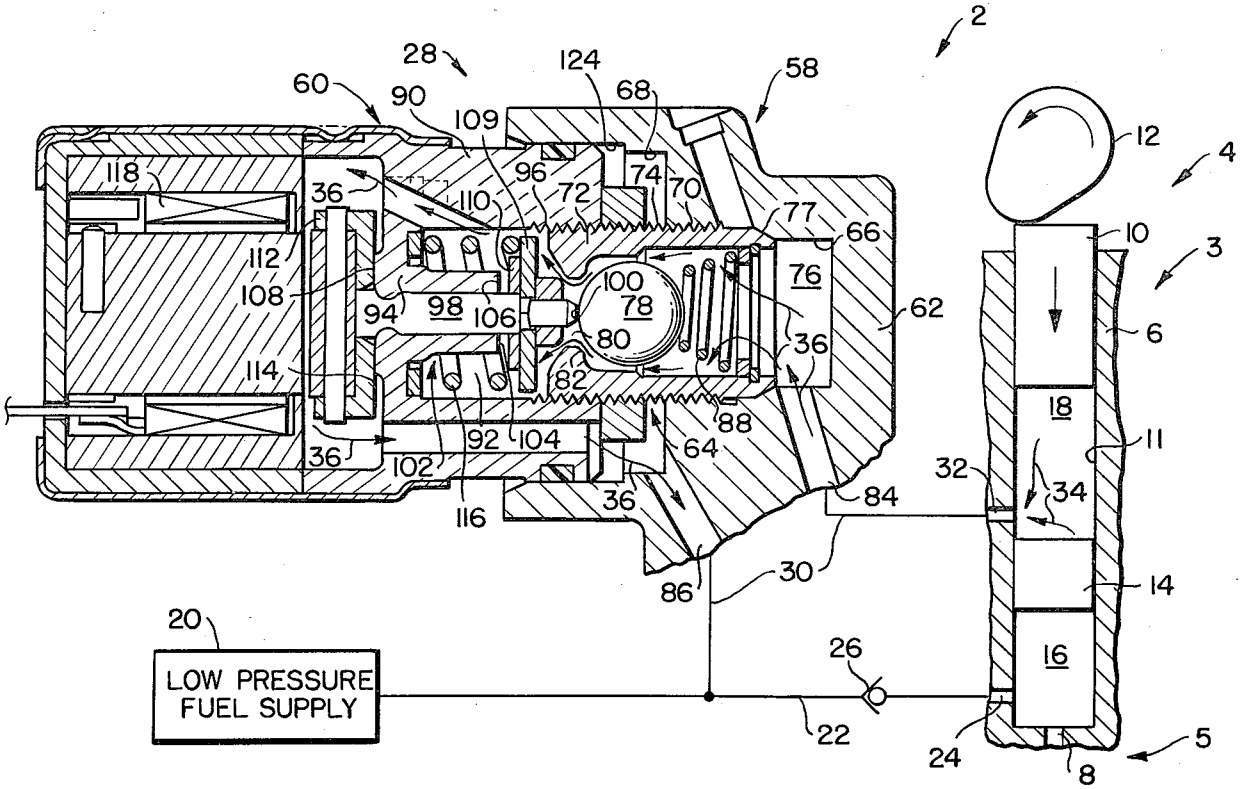
FIG. 1 is a partially broken away cross-sectional view of a solenoid operated valve and hydraulic link controlled fuel injector designed in accordance with the subject invention wherein the valve is in an opened condition to allow the collapse of the hydraulic link.

For a clear understanding of the subject invention, reference is initially made to FIG. 1 wherein a fuel injector and valve assembly 2 designed in accordance with the subject invention is illustrated. Before the details of the valve are discussed, reference will initially be made to the structure and operation of the injector 4 which is of the unit type, that is the injector includes both a high-pressure pump section 3 and an injection nozzle section 5 in a single injector housing 6. In particular, the injector includes a nozzle structure 8 through which fuel may be injected into the cylinder (not illustrated) of an engine in timed sequence with the movement of an engine piston (not illustrated) within the cylinder. As is well known in the fuel control art, the efficient operation of an internal combustion engine depends upon the proper quantity and timing of fuel injected dependent upon a variety of engine operating parameters such as temperature, speed and load. In the subject injector design, a main pumping plunger 10 is mounted for reciprocating motion within one end of an elongated cavity 11 in injector housing 6. Plunger 10 reciprocates in response to the rotational movement of a cam 12 which may be connected to a standard valve operating cam shaft (not illustrated) of an internal combustion engine. The portion of the elongated cavity 11 not occupied by plunger 10 is divided by a shuttle piston 14 into an injection cavity 16 communicating with the nozzle structure 8 and a control cavity 18 separating the main pumping plunger 10 and the shuttle piston 14. Injection cavity 16 may be continuously supplied with fuel from a low pressure fuel supply 20 through a supply line 22 connected to cavity 16 by supply port 24. A check valve 26 operated to allow fuel to flow into the injection cavity 16 through port 24 but prevents reverse flow therefrom. It can now be easily appreciated that so long as shuttle piston 14 moves upwardly with main pumping plunger 10, fuel from supply 20 would be allowed to pass into injection cavity 16. Upon downward movement of shuttle piston 14, check valve 26 would close and the fuel previously metered into cavity 16 would be displaced therefrom through nozzle structure 8 which may be either of the "closed" or "open" type. In a closed nozzle, a spring biased valve is placed in the nozzle and is normally closed except when pressure within the injection cavity reaches a predetermined level at which point the valve opens to allow injection into the engine cylinder. An open nozzle includes no closing structure and thus permits communication at all times between the injection cavity and the engine cylinder. When an open nozzle is employed, the supply line 22 and check valve 26 may be modified to prevent continuous flow of fuel through nozzle structure 8.

Figures 2A, 2B:
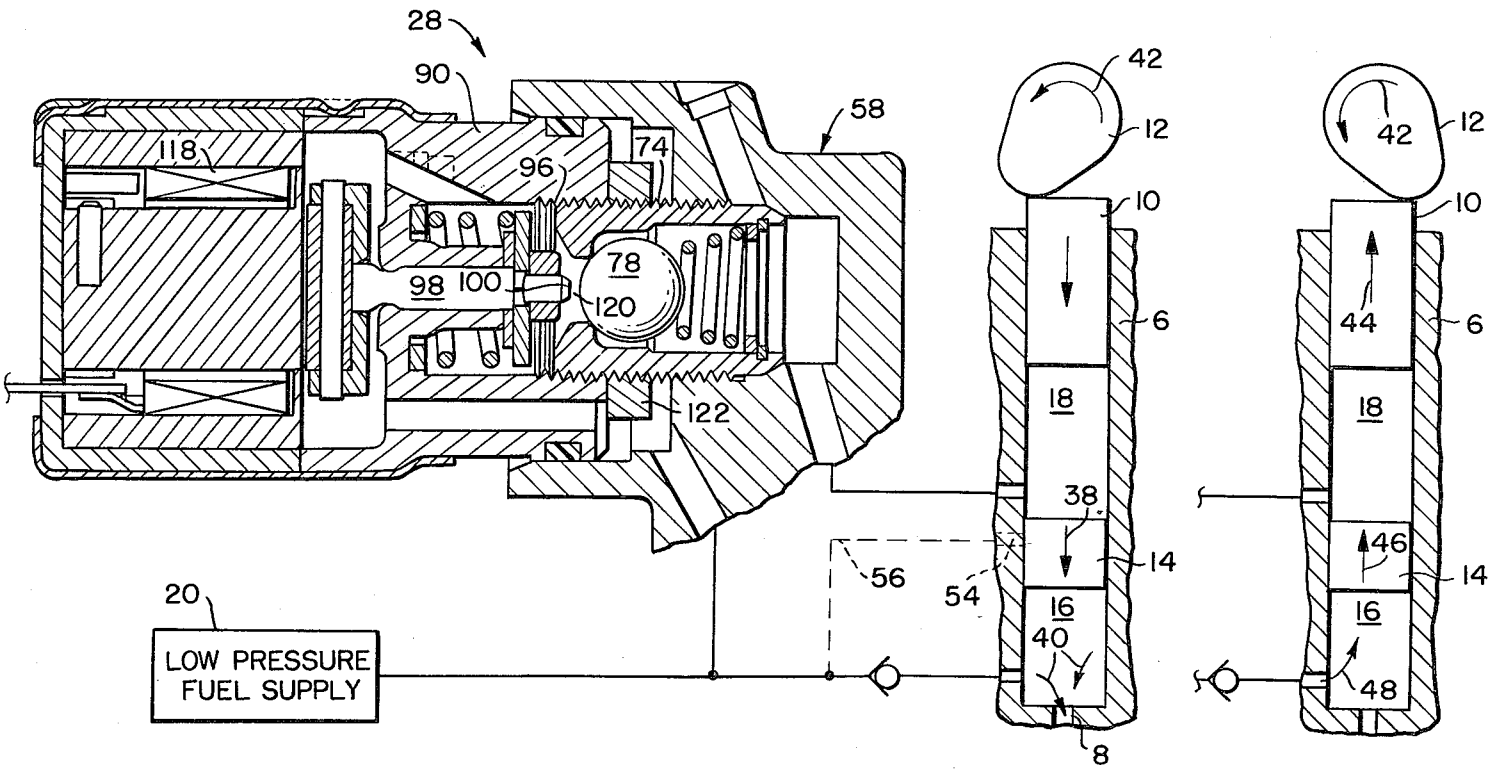
FIG. 2A is a partially broken away cross-sectional view of the valve and fuel injector of FIG. 1 wherein the valve has been moved to a closed position to activate the hydraulic link of the fuel injector.
FIG. 2B is a partially broken away cross-sectional view of a fuel injector of the type illustrated in FIGS. 1 and 2A wherein fuel is being metered into an injection cavity of the injector.

The desired timed movement of shuttle piston 14 is achieved by making or breaking a hydraulic link within control cavity 18 by means of the solenoid operated valve 28 illustrated in FIG. 1. In particular, valve 28 operates to open or close a control line 30 which interconnects the low pressure fuel supply 20 with the control cavity 18 through a control port 32. As main pumping plunger 10 moves downwardly (see FIG. 1) any fuel within control chamber 18 would tend to be ejected through control port 32, as illustrated by arrows 34, pass through valve 28, as illustrated by arrows 36, and return to the low pressure fuel supply through lines 30 and 32. As soon as valve 28 moves to its closed position, such as illustrated in FIG. 2A, continued downward movement of the main pumping plunger 10 will cause shuttle piston 14 to move in unison therewith by virtue of the hydraulic link formed by the fuel trapped in control cavity 18. When the shuttle piston 14 moves downwardly, shown by arrow 38, any fuel existing within ejection cavity 16 will be forced through nozzle structure 8 as illustrated by arrow 40. As cam 12 continues its rotation in the direction illustrated by arrow 42, main pumping plunger 10 will reverse direction as illustrated by arrow 44 in FIG. 2B. So long as valve 28 remains closed, shuttle piston 14 will tend to continue its travel in unison with main pumping plunger 10 and thus will tend to move upwardly as illustrated by arrow 46 when plunger 10 reverses direction under the control of cam 12. During this upward movement of shuttle piston 14, fuel will be metered into injection cavity 16 as illustrated by arrow 48.

Figure 3:
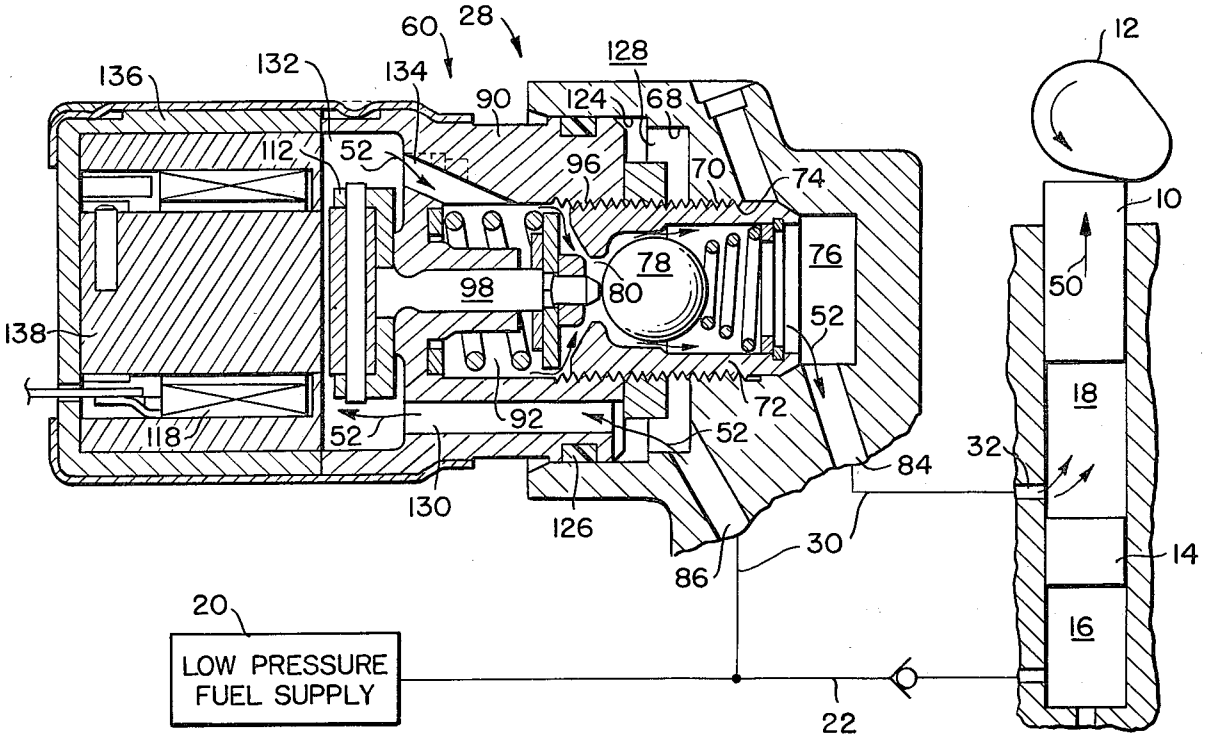
FIG. 3 is a partially broken away cross-sectional view of a solenoid valve controlled fuel injector as illustrated in FIGS. 1, 2A and 2B wherein the valve is in an opened condition to allow fuel to pass from a low pressure fuel supply into a control cavity of the injector to present further metering of fuel into the injection cavity of the fuel injector.

Turning now to FIG. 3, the metering of fuel into cavity 16 ceases upon opening of valve 28 even though main pumping plunger 10 continues its upward movement illustrated by arrow 50. Fuel now moves in the reverse direction from the low pressure fuel supply through lines 22 and 30, through valve 28 as illustrated by arrows 52 and into control cavity 18 through control port 32. By properly timing the closing of valve 28 during downward movement of plunger 10, the moment at which injection begins may be arbitrarily selected as desired. Similarly, the amount of fuel metered into injection cavity 16 in preparation for subsequent injection may be controlled by arbitrarily selecting the moment at which the valve 28 is reopened during the upward movement of pumping plunger 10. A more thorough discussion and explanation of the general type of injector to which this invention is directed is contained in U.S. Pat. No. 4,235,374, issued Nov. 25, 1980.

Numerous modifications to the unit injector structure illustrated in FIGS. 1–3 are possible, some of which are illustrated in U.S. Pat. No. 4,235,374. In particular, check valve 26 may be incorporated into shuttle piston 14 and/or a spill port 54 (FIG. 2A) may be provided to create a constant "end-of-injection" position for shuttle piston 14. As illustrated in FIG. 2A, spill port 54 (shown in dashed lines) could operate to cause the fuel to be spilled from control cavity 18 and returned to the low pressure fuel supply via a spill line 56. Various scavenging passages may also be incorporated in the valve structure to purge air and particles which may enter the injector. Fuel need not be used to form the hydraulic link since another fluid might be employed as long as it is non-compressible.

While the unit injector described above affords great flexibility in both timing and metering fuel injection by simply varying the respective periods of opening and closing of valve 28 during each revolution of cam 12, it is clear that a separate control valve 28 must be provided for each cylinder of the engine. Clearly, for adoption of the fuel control system discussed above to be economically feasible, the electrically controlled valve 28 must be reasonable in cost and reliable in operation. Satisfying the limitations on cost is extremely difficult in view of the operating parameters which must be satisfied. In particular, the valve must be capable of sealing hydraulic pressures up to and in excess of 15,000 psi and yet must be capable of moving between the fully opened and fully closed positions in less than one millisecond. Moreover, in the fully opened position, the valve must be capable of accommodating a substantial fluid flow either into or out of the control cavity 18 which is sufficient to arrest selectively the movement of shuttle piston 14 even when plunger 10 is moving rapidly.

The valve design to which the subject invention is directed satisfies all of the requirements referred to above by employing a relatively inexpensive ball-check valve structure and a spring biased valve operator designed to allow the valve to close only upon energization of a solenoid. Reference is now made to FIG. 1 in which a control valve designed in accordance with the subject invention is illustrated in detail. The valve essentially includes two main components, i.e., a valve housing 58 and a valve operator 60 rotatably connected to valve housing 58 for reasons which will be explained in more detail hereinbelow. Valve housing 58 includes an outer valve housing member 62 containing a recess 64 counterbored to form an inner recess 66 and an outer recess 68. The inner recess 66 includes internal threads 70. Disposed within recess 64 is an inner valve housing member 72 having external threads 74 for mating with the internal threads 70 of the outer valve housing member 62. The inner valve housing member 72 is generally cylindrical in shape and combines with the outer valve housing member 62 to define a valve cavity 76 within which is disposed the ball valve element 78. The inner and outer valve housing members 62 and 72 are formed with mating conical sealing surfaces which may be placed under significant compressive force by mating threads 70 and 74 to allow the valve cavity 76 to be sealed against very high back pressures produced in control cavity 18.

Outer recess 68 is sealed at one end by mating threads 70 and external threads of inner valve housing member 72. The other end of outer recess 68 is sealed on the inside by mating threads 96 and external threads 74 and on the outside by a sealing engagement between the exterior of operator 60 and a cylindrical surface 124 forming a portion of outer recess 68. To assist in forming a tight fuel seal, an "O" ring seal may be provided between operator 60 and surface 124. As is evident in FIG. 1, inner valve housing member 72 projects into outer recess 68 to form an annular channel between the exterior of member 72 and cylindrical surface 124. Operator 60 serves to seal one end of this annular channel to form an annular flow cavity 128 with which inlet passage 86 communicates.

At one end, the inner valve housing member 72 extends radially inwardly to form a flow control passage 80 surrounded by valve seat 82. As will be explained below, flow control passage 80 provides the only passage for communication between the inlet and outlet passages 84,86 and thus valve 28 is fully closed when the ball valve element 78 engages the valve seat 82. Ball element 78 is normally biased toward the closed position by a conical compression spring 88 which serves to hold ball element 78 against the valve seat 82 with sufficient force to resist opening of the valve under the pressure of fluid supplied through valve inlet passage 86.

Valve operator 60 includes an operator housing 90 containing a central cavity 92 open at one end and closed at the other by a radially extending wall 94. Internal threads 96 are arranged to mate with a set of external threads on the inner valve housing member 72 which extends into outer recess 68. Valve operator 60 forms means for moving ball valve element 78 between its open and closed position in response to an electrical control signal in less than one millisecond. In particular, valve operator 60 includes a stem 98 having a longitudinal axis aligned with the center of ball 78 and coincident with the longitudinal axis of central cavity 92. Stem 98 is mounted to move between a forward position, illustrated in FIG. 1, in which one end 100 contacts ball element 78 to move the ball element to its open position and a retracted position, illustrated in FIG. 2A, in which the stem 98 moves leftwardly to form a predetermined gap 120 between end 100 and ball element 78. The size of gap 120 is extremely important to the proper operation of the subject valve since too large a gap size would delay valve response by requiring the operator to move a substantial distance before contacting the ball. On the other hand, designing too small a gap would require high precision machining accuracy to insure that ball element 78 is fully seated when the stem is retracted. A stem guide means 102 is provided for restricting radial movement of stem 98 while permitting movement between the advanced and retracted positions. The stem guide means is formed by a sleeve 104 connected to the radially extending wall 94. At one end of sleeve 104, a first stop 106 is formed for arresting longitudinal movement of the stem in its retracted position. At the other end of sleeve 104 is a second stop 108 for arresting longitudinal movement of the stem 98 in its advanced position. As is shown in FIG. 1, stem 98 carries a first radially extending member 109 such as a washer adjacent end 100. The first radially extending member 109 includes a first stop engaging surface or means 110 for engaging first stop 106. A second radially extending member 112 is connected to the opposite end of stem 98 and is formed of magnetic flux conducting material to serve as an armature as will be explained hereinbelow. On one side of member 112, a second stop engaging surface or means 114 is formed for engaging the second stop 108. As is evident from FIG. 1, the axial thickness of the first radially extending member 109 may be modified by employing an additional washer-like structure or a thinner washer-like structure to adjust the longitudinal distance between the advanced and retracted distance of stem 98.

An operator biasing means in the form of coil spring 116 is inserted in central cavity 92 surrounding stem 98 with one end in contact with radially extending wall 94 and the other end in contact with the first radially extending member 109. Obviously by this arrangement, stem 98 is biased toward its advanced position. Spring 116 is chosen to impart an opening force on ball element 78 sufficient to overcome the closing force imparted to ball 78 by spring 88.

Electromagnetic means including a solenoid coil 118 is connected to operator housing 90 in such a position to cause the armature formed by the second radially extending member 112 to move stem 98 to its retracted position against the force of spring 116 whenever coil 118 is electrically energized. FIG. 2A illustrates the condition of valve 28 when coil 118 is being energized. FIG. 2A also discloses, in exaggerated form, the desired gap 120 between ball element 78 and end 100 of stem 98 when stem 98 is being held in its retracted position by solenoid 118. As noted above, the dimension of gap 120 in the axial direction is critical to the proper operation of the subject control valve because too large a gap would delay opening of the valve whereas too small a valve would create the possibility of improper valve closing. Ideally this gap should be approximately 0.002 inches to remove the requirement for extremely exacting manufacturing tolerances and to allow for recalibration upon wear. Operator housing 90 is adjustably connected with valve housing 58 by means of mating threads 96 and 74. Since these threads are coaxial with the longitudinal axis of stem 98, relative rotation of housings 58 and 90 will permit end 100 of stem 98 to be adjusted axially with respect to ball element 78 in its closed position thereby adjusting the thickness of gap 120. Once this gap is properly adjusted, the rotational position of housing 58 and 90 may be fixed by means of a set screw, not illustrated, or a lock nut 122. Accordingly, threads 74 and 96 and lock nut 122 form adjustable connecting means connecting the operator housing 90 to the valve housing 58 in a manner to permit the operator housing 90 to be adjusted in position along the longitudinal axis of stem 98, relative to valve housing 58 thereby adjusting gap 120. Repositioning of the operator housing 90 relative to the valve housing 58 also has the effect of controlling the opening distance between the ball valve element 78 relative to the valve seat 82 when the stem 98 is in its advanced position. Obviously, opening distance is a function not only of the relative positions of the valve and operator housings but also of the distance between the advanced and retracted positions of stem 98. An illustrative distance between the advanced and retracted positions for one practical application of the subject valve would be 0.014 inches. Accordingly, if gap 120 is set at 0.002 inches, the resulting distance between the valve seat 82 and the ball element 78 would be 0.012 inches when the ball element 78 is in its open position.

Reference is now made to FIG. 3 for a description of the flow pattern through control valve 28. When operating in the condition shown in FIG. 3, fluid enters inlet passage 86 and passes into annular flow cavity 128. Fluid passes from annular flow cavity 128 through operator housing 90 into flow control passage 80, valve cavity 76 and outlet passage 84 before it reaches the control cavity 18 of the fuel injector. Fluid from annular flow cavity 128 reaches the central cavity 92 of the operator housing by means of connecting passages including one or more axial passages 130 extending from the annular flow cavity 128 to a end recess 132 within which the radially extending member 112 is positioned. From end recess 132 fluid flows into the central cavity 92 by means of one or more radially inwardly directed passages 134. The open end of end recess 132 is fluidically sealed by solenoid housing 136 within which is mounted a stator 138 containing solenoid coil 118. Of course, when the control valve 28 and injector are operating in the mode illustrated in FIG. 1, flow of fluid through control valve 28 will be in the direction opposite that illustrated in FIG. 3. The axial length of end recess 132 is selected to insure at least a minimal 0.002 inch gap between the stator 138 and armature forming element 112 when the stem 98 is in its fully retracted position. By this arrangement of the flow pattern in housing 90, all fluid pressures exerted on stem 98 and the radially extending elements 109 and 112 attached thereto are fully balanced to thereby impart no axial bias in either direction.

For illustrative purposes only, the dimensions of an operative embodiment of the subject valve for use in a practical unit type injector having a pumping plunger and shuttle piston as described above would be as follows:

| | |
|---|---|
| Ball element (78) diameter | 5/16" |
| Flow control passage (80) diameter | .20" |
| Axial distance between advanced and retracted positions of stem (98) | .014" |
| Distance between armature (112) and solenoid stator (138) upon full retraction of stem (98) | .002" |
| Operator coil spring (116) | 16 lbs. extended<br>18.7 lbs. compressed |
| Ball spring (88) | 7 lbs. extended<br>7.4 lbs. compressed |

INDUSTRIAL APPLICABILITY

The subject control valve would find particular utility as the control element of a unit type fuel injector employing a cam operated pumping plunger and fluidically linked shuttle piston. In particular, the valve and injector assembly of the type to which this invention is directed would be particularly effective in providing the fuel injection to a compression ignition internal combustion engine. Other applications would include any environment in which a low-cost, fast acting solenoid control valve is required.

I claim:

1. A valve for controlling fluid flow between a low pressure fluid supply and a fluid utilizing device which produces a back pressure which varies above and below the supply pressure, comprising (a) a valve housing containing a valve cavity, an inlet passage for connection with the low pressure fluid supply, an outlet passage for connection with the fluid utilizing device, and a flow control passage arranged to provide the sole path for fluid communication between said inlet and outlet passages through said valve cavity, said valve housing including a valve seat surrounding said flow control passage;

(b) a ball positioned within said valve cavity and movable between a closed position in which said ball contacts said valve seat to form a seal capable of preventing back flow from said outlet passage to said inlet passage and an open position in which fluid may flow in either direction between said inlet and outlet passages;

(c) ball biasing means for continuously biasing said ball toward said closed position with a closing force sufficient to maintain said ball in said closed position even when the back pressure drops below the supply pressure;

and (d) operator means included within an operator housing for moving said ball between said open and closed positions in response to an electrical control signal, said operator means including (1) a stem having a longitudinal axis aligned with the center of said ball and movable between an advanced position in which one end of said stem contacts said ball to move said ball to said open position and a retracted position in which a predetermined gap is formed between said one end of said stem and said ball when said ball is in said closed position to insure full closure of said valve, (2) operator biasing means for biasing said stem toward said advanced position with an opening force sufficient to overcome the biasing force imparted to said ball by said ball biasing means, said operator biasing means including a coil compression spring positioned coaxially around said stem, (3) an electromagnetic means for moving said stem from said advanced position to said retracted position when electrically energized and for allowing said stem to be moved to said advanced position under the force imparted thereto by said operator biasing means, said opening force being sufficiently greater than said closing force to cause said ball to move from said closed to said open position in less than one millisecond, and (4) adjustable connecting means for adjustably connecting said operator housing to said valve housing in a manner to permit said operator housing to be moved in position along the longitudinal axis of said stem relative to said valve housing to adjust the clearance between said valve seat and said ball when said stem is moved to its advanced positions and for adjusting said predetermined gap between said ball and said one end of said stem when said stem is in said retracted position.

2. A valve as defined in claim 1, wherein said operator housing has stem guide means for restricting radial movement of said stem while permitting axial movement of said stem between said advanced and retracted positions.

3. A valve as defined in claim 2, wherein said valve housing includes an outer housing member containing a recess having internal threads and an inner housing member containing said valve seat and flow control passage and having a first set of external threads for mating with said internal threads of said valve housing, said inner housing member operating to fluidically seal one portion of said recess to form said valve cavity when interconnected by said threads with said outer housing member.

4. A valve as defined in claim 3, wherein said recess is counterbored to form an inner recess portion containing said internal threads and an outer recess portion larger in diameter than said inner recess portion, said inner housing member extending axially into said outer recess portion to form an annular channel, said inner housing member including a second set of external threads which extend into said annular channel, and wherein said operator housing includes a central cavity having a central axis coincident with the longitudinal axis of said stem and wherein said connecting means includes internal threads within said central cavity adapted to mate with said second set of external threads of said inner housing member whereby rotation of said operator housing relative to said valve housing will cause adjustment in the retracted and advanced positions of said stem relative to said valve seat.

5. A valve as defined in claim 4, wherein said operator housing includes outer seal means for sealing said annular channel to form an annular flow cavity surrounding said inner housing member, said inlet passage of said valve housing opening into said annular flow cavity, said operator housing including a connecting passage between said annular flow cavity and said central cavity of said operator housing, said central cavity being fluidically connected to said valve cavity by said flow control passage of said inner housing member.

6. A valve as defined in claim 2, wherein said stem guide means includes a first stop for arresing longitudinal movement of said stem in said retracted position and a second stop for arresting longitudinal movement of said stem in said advanced position.

7. A valve as defined in claim 6, wherein said stem includes a first stop engaging means positioned adjacent said one end of said stem for engaging said first stop and a second stop engaging means for engaging said second stop, at least one of said first or second stop engaging means being adjustable along the longitudinal axis of said stem to adjust the longitudinal distance between said advanced and retracted positions.

8. A valve as defined in claim 7, wherein said first stop engaging means includes a first radially extending member, said coil compression spring having one end engaged with said radially extending member and another end engaged with a radial end wall of said central cavity of said operator housing.

9. A valve as defined in claim 8, wherein said second stop engaging means includes a second radially extending member formed of magnetic flux conducting material, and wherein said operator means includes a solenoid means connected with said operator housing positioned to magnetically attract said second radially extending member with sufficient force directed along the longitudinal axis of said stem to cause said stem to move from said advanced position to said retracted position against the bias of said coil compression spring when said solenoid is electrically energized.

10. A valve as defined in claim 9, wherein said second radially extending member resides within an end recess of said operator housing, said end recess being fluidically sealed at one end by said solenoid means, said end cavity forming one portion of said connecting passage and being shaped to maintain a desired gap between said second radially extending member and said solenoid means when said stem is in said retracted position, said central and end cavities and said guide means being formed to prevent any net static force from being imposed on said stem by the fluid within said valve operator means.

11. A valve as defined in claim 4, wherein said adjustable connecting means includes a locking means for locking selectively said operator and valve housings in a relatively fixed position.

12. A fuel injector responsive to an electrical control signal to both time and meter periodic fuel injections, comprising (a) a fuel injector housing containing an injection cavity having an inlet through which each quantity of fuel to be injected is metered and having an outlet through which the metered fuel passes during each subsequent injection period;

(b) a reciprocating plunger;

(c) a shuttle piston mounted for reciprocation to increase and decrease the effective size of said injection cavity;

(d) hydraulic means for controllably linking said shuttle piston to reciprocate with said reciprocating plunger;

(e) an electrically controlled valve to break the hydraulic link between said reciprocating plunger and said shuttle piston for a selected time at least once during each reciprocation cycle of said plunger to both meter and time said fuel injection on a cycle by cycle basis, said valve including (1) a valve housing containing a valve cavity, an inlet passage for connection with a fluid supply, an outlet passage for connection with said hydraulic means and a flow control passage arranged to provide the sole path for fluid communication between said inlet and outlet passage through said valve cavity, said valve housing including a valve seat surrounding said flow control passage;

(2) a ball positioned within said valve cavity and movable between a closed position in which said ball contacts said valve seat to form a seal capable of preventing back flow from said hydraulic means through said outlet passage to said inlet passage and an open position in which fluid may flow in either direction between said inlet and outlet passages;

(3) ball biasing means for continuously biasing said ball toward said closed position with a closing force sufficient to maintain said ball in said closed position even when the back pressure drops below the fluid supply pressure; and (4) operator means for moving said ball between said open and closed positions in response to an electrical control signal in less than one millisecond, wherein said operator means includes (a) a stem having a longitudinal axis aligned with the center of said ball and movable between an advanced position in which one end of said stem contacts said ball to move said ball to said open position and a retracted position in which a predetermined gap is formed between said one end of said stem and said ball when said ball is in said closed position to insure full closure of said valve, (b) operator biasing means for biasing said stem toward said advanced position with an opening force sufficient to overcome the biasing force imparted to said ball by said ball biasing means, said operator biasing means including a coil compression spring coaxially surrounding said stem, and (c) an electromagnetic means for moving said stem from said advanced to said retracted position when electrically energized and for allowing said stem to be moved to said advanced position under the force imparted thereto by said operator biasing means.

13. A fuel injector as defined in claim 12, wherein said operator means includes an operator housing having stem guide means for restricting radial movement of said stem while permitting axial movement of said stem between said advanced and retracted positions, and wherein said operator means includes adjustable connecting means for connecting said operator housing to said valve housing in a manner to permit said operator housing to be adjusted in position along the longitudinal axis of said stem relative to said valve housing to adjust the clearance between said valve seat and said ball when said ball is moved to its open position and for adjusting said predetermined gap between said ball and said one end of said stem when said stem is in said retracted position.

14. A fuel injector as defined in claim 13, wherein said valve housing includes an outer housing member containing a recess having internal threads and an inner housing member containing said valve seat and flow control passage and having a first set of external threads for mating with said internal threads of said valve housing, said inner housing member operating to fluidically seal one portion of said recess to form said valve cavity when interconnected by said threads with said outer housing member.

15. A fuel injector as defined in claim 14, wherein said recess is counterbored to form an inner recess portion containing said internal threads and an outer recess portion larger in diameter than said inner recess portion, said inner housing member extending axially into said outer recess portion to form an annular channel, said inner housing member including a second set of external threads which extend into said annular channel, and wherein said operator housing includes a central cavity having a central axis coincident with the longitudinal axis of said stem and wherein said connecting means includes internal threads within said central cavity adapted to mate with said second set of external threads of said inner housing member whereby rotation of said operator housing relative to said valve housing will cause adjustment in the retracted and advanced positions of said stem relative to said valve seat.

16. A fuel injector as defined in claim 15, wherein said operator housing includes outer seal means for sealing said annular channel to form an annular flow cavity surrounding said inner housing member, said inlet passage of said valve housing opening into said annular flow cavity, said operator housing including a connecting passage between said annular flow cavity and said central cavity of said operator housing, said central cavity being fluidically connected to said valve cavity by said flow control passage of said inner housing member.

* * * * *